US008343023B2

(12) United States Patent
Stroinski et al.

(10) Patent No.: US 8,343,023 B2
(45) Date of Patent: Jan. 1, 2013

(54) METHOD AND DEVICE FOR PRODUCING A HIGHLY PRECISE BOX

(75) Inventors: Uwe Stroinski, Waiblingen (DE); Ruppert Greiter, Durach (DE); Robert Kuhn, Kempten (DE)

(73) Assignee: Robert Bosch GmbH, Stuttgart (DE)

( * ) Notice: Subject to any disclaimer, the term of this patent is extended or adjusted under 35 U.S.C. 154(b) by 743 days.

(21) Appl. No.: 12/374,543

(22) PCT Filed: May 23, 2007

(86) PCT No.: PCT/EP2007/054990

§ 371 (c)(1),
(2), (4) Date: Sep. 14, 2009

(87) PCT Pub. No.: WO2008/009501

PCT Pub. Date: Jan. 24, 2008

(65) Prior Publication Data

US 2010/0056352 A1 Mar. 4, 2010

(30) Foreign Application Priority Data

Jul. 20, 2006 (DE) ..... 10 2006 033 630

(51) Int. Cl.
*B31B 1/28* (2006.01)

(52) U.S. Cl. ..... 493/89; 493/84; 493/162; 493/175

(58) Field of Classification Search ..... 493/52, 493/84, 89, 162, 163, 175
See application file for complete search history.

(56) References Cited

U.S. PATENT DOCUMENTS

| | | | | | |
|---|---|---|---|---|---|
| 3,792,811 | A | | 2/1974 | Carpenter et al. | |
| 4,084,393 | A | * | 4/1978 | Focke | 53/136.4 |
| 4,292,102 | A | * | 9/1981 | Bidegain | 156/213 |
| 4,308,023 | A | * | 12/1981 | Bidegain | 493/295 |
| 4,349,345 | A | * | 9/1982 | Bodendoerfer | 493/295 |
| 4,445,634 | A | | 5/1984 | Sato | |
| 4,487,596 | A | * | 12/1984 | Livens et al. | 493/125 |
| 4,619,637 | A | * | 10/1986 | Jones | 493/175 |
| 4,676,860 | A | | 6/1987 | Lee et al. | |
| 4,708,704 | A | * | 11/1987 | Focke et al. | 493/151 |
| 4,761,156 | A | * | 8/1988 | Bachner et al. | 493/133 |
| 4,932,930 | A | * | 6/1990 | Coalier et al. | 493/128 |
| 5,092,107 | A | * | 3/1992 | Lamm | 53/449 |
| 5,205,807 | A | * | 4/1993 | Adams et al. | 493/125 |
| 5,236,084 | A | * | 8/1993 | Evers | 206/273 |
| 5,295,623 | A | * | 3/1994 | Bacques et al. | 229/109 |
| 5,400,955 | A | * | 3/1995 | Coalier et al. | 229/108 |
| 5,549,537 | A | * | 8/1996 | Focke et al. | 493/162 |
| 6,609,352 | B1 | | 8/2003 | Erlund et al. | |

(Continued)

FOREIGN PATENT DOCUMENTS

DE 1115567 10/1961

(Continued)

*Primary Examiner* — Christopher Harmon
(74) *Attorney, Agent, or Firm* — Michael Best & Friedrich LLP

(57) ABSTRACT

The invention relates to a method for producing an outer box and a drawer for packaging purposes, and to a corresponding device for producing the outer box and drawer. A first machine produces the outer box, a second machine produces the drawer, and a shared main drive drives the devices of the first machine and the second machine. The first and second machines transform flat blanks into an outer box and a drawer respectively, by a series folding and welding steps.

8 Claims, 6 Drawing Sheets

U.S. PATENT DOCUMENTS

| | | | | |
|---|---|---|---|---|
| 7,717,838 | B2 * | 5/2010 | Strong et al. | 493/175 |
| 2002/0100535 | A1 | 8/2002 | Yamazaki et al. | |
| 2005/0079965 | A1 * | 4/2005 | Moshier et al. | 493/52 |

FOREIGN PATENT DOCUMENTS

| | | | |
|---|---|---|---|
| DE | 3602146 | A1 | 8/1986 |
| DE | 3920162 | A1 | 1/1991 |
| EP | 0071649 | A1 | 2/1983 |
| EP | 0761424 | A1 | 3/1997 |
| JP | 59150723 | A | 8/1984 |
| WO | 0053503 | A1 | 9/2000 |
| WO | 0168457 | A1 | 9/2001 |
| WO | 2005049437 | A1 | 6/2005 |

* cited by examiner

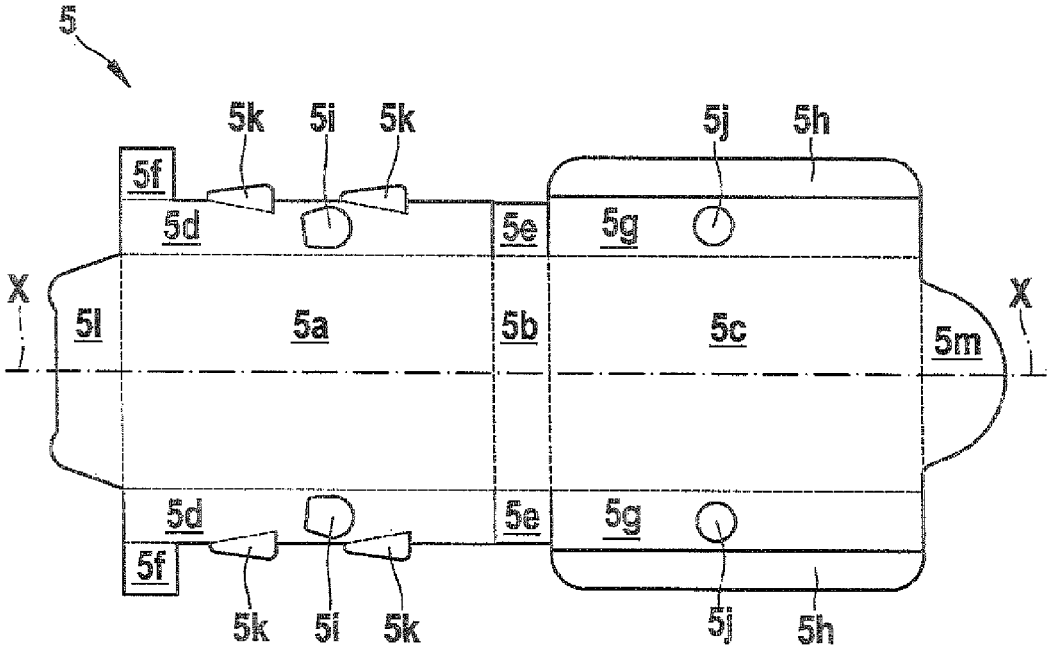
Fig. 3
Fig. 4
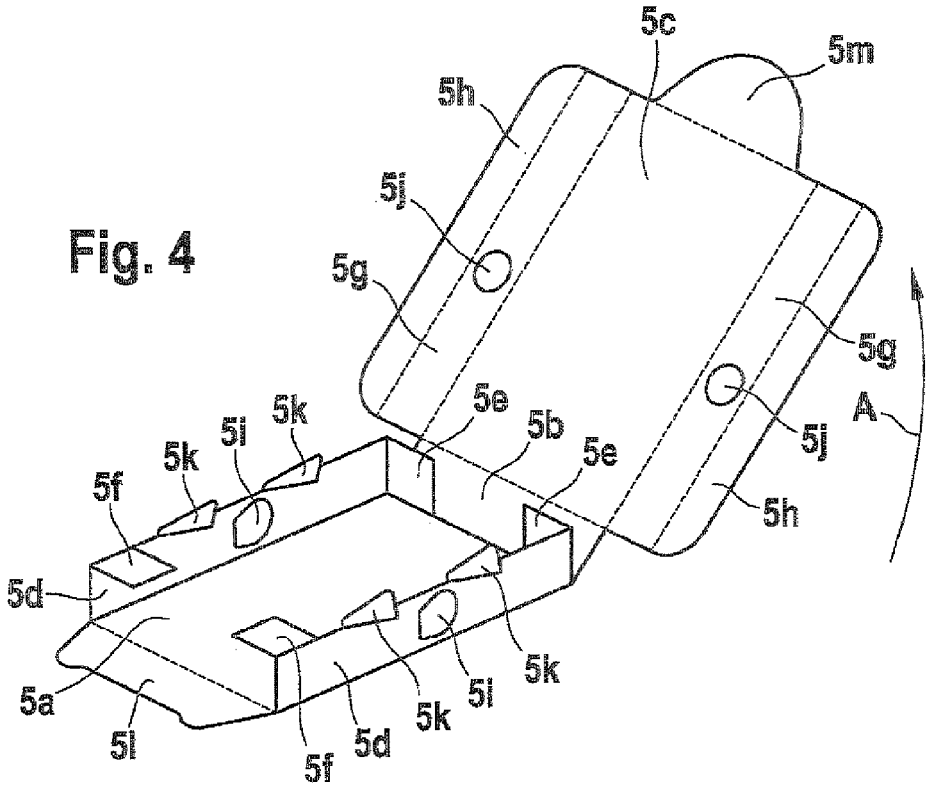

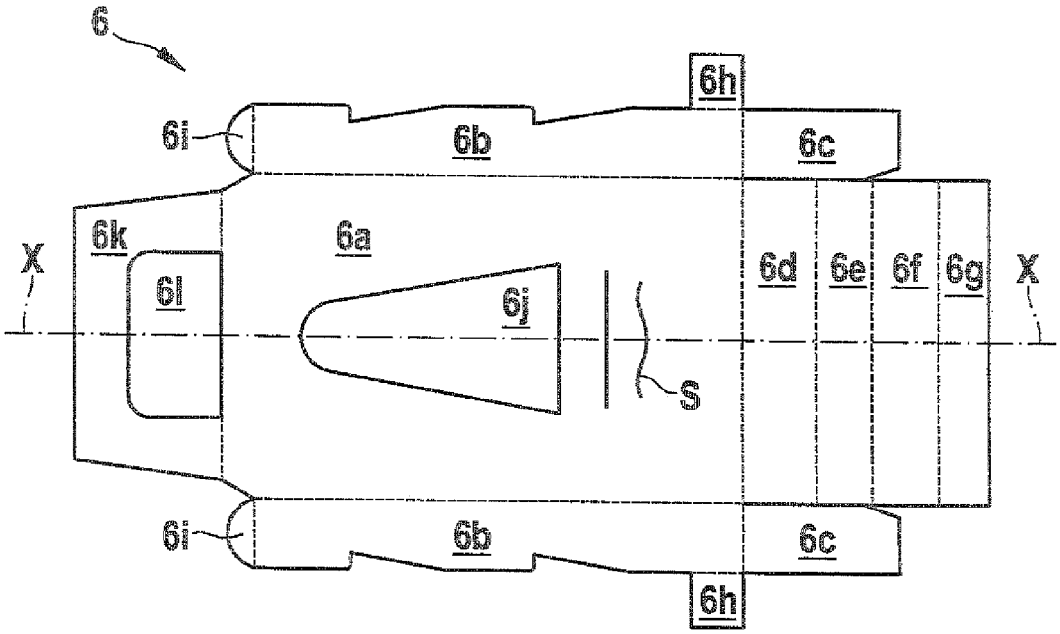
Fig. 7
Fig. 8
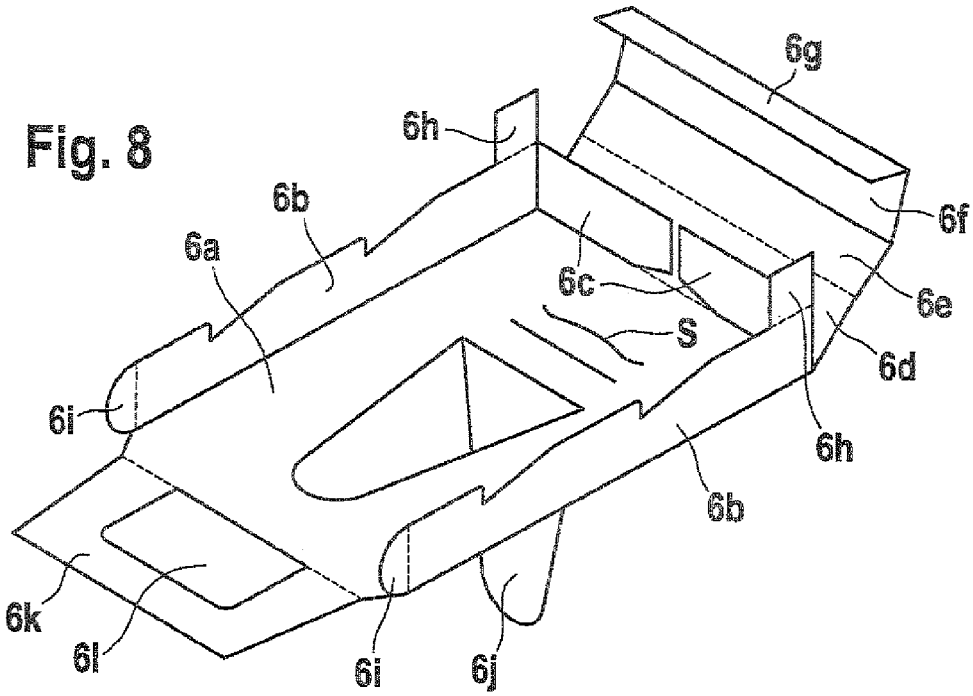

METHOD AND DEVICE FOR PRODUCING A HIGHLY PRECISE BOX

CROSS-REFERENCE TO RELATED APPLICATION

This application is a 35 USC 371 application of PCT/EP 2007/054990 filed on May 23, 2007.

BACKGROUND OF THE INVENTION

Field of the Invention

Description of the Prior Art

Boxes of this kind are used, for example, for packaging small items, e.g. cosmetics articles or medications. In addition, packages of this kind should have a certain degree of stability. Previously known boxes, however, are relatively complex and expensive to manufacture.

ADVANTAGES AND SUMMARY OF THE INVENTION

The method according to the invention for manufacturing an outer box has the advantage over the prior art that the method according to the invention permits a highly precise outer box to be manufactured for a reasonable price. In addition, the outer box according to the invention has a high degree of stability. As a result, such outer boxes are able to withstand powerful mechanical stresses. The method according to the invention includes the steps of preparing a flat blank, and bending and folding the flat blank into an essentially U-shaped intermediate form by folding the left and right base side walls in relation to a base surface. The method according to the invention also includes the step of folding a rear end surface, which adjoins the base surface. Then, a cover surface, which adjoins the rear end surface, is folded over to cover the U-shaped intermediate form. At this point, the cover surface and the base surface are then parallel to each other. This is followed by a step in which the cover surface is welded to the U-shaped intermediate form to complete the outer box. It should be noted that the respective folding edges between the individual surfaces are preferably already prepared in the blank. This permits the respective folding procedure to be carried out more simply and with a high degree of precision.

Preferably, the flat blank has left and right reinforcing tabs, which adjoin the rear end surface and are folded inward before the rear end surface is folded into position. Then, the reinforcing tabs are welded to the rear end surface. This makes it possible to achieve a wider reinforcement of the outer box.

According to another preferred embodiment, the flat blank has support tabs at its open end surface, which are folded inward before the cover surface is folded over and are then welded to the cover surface.

In order to achieve a particularly short manufacturing time of the outer box, the welding of the reinforcing tabs to the rear end surface and the welding of the support tabs to the cover surface occurs at the same time; alternatively, however, these procedures can also be carried out in series.

According to another preferred embodiment, the cover surface is laterally adjoined in the longitudinal direction of the outer box by left and right cover side surfaces, which are welded to the right and left base side walls on the base surface. This achieves a reinforcing of the side regions of the outer box.

According to another preferred embodiment of the invention, the left and right cover side surfaces of the cover surface are also provided with left and right bottom tabs that are welded to an underside of the base surface. According to another preferred embodiment, the flat blank has a securing tab, which is folded inward into the outer box after the cover surface has been welded into place. This makes it possible to manufacture a childproof package.

Preferably, the cover surface is adjoined by an upper reinforcing tab, which is folded inward into the outer box after the cover surface is welded to the U-shaped intermediate form. In this case, the upper reinforcing tab is also welded to the cover surface in order to achieve an optimal reinforcing action.

In order to permit the fastest and most reasonably priced manufacture possible, the flat blank is folded into the U-shaped intermediate form around an essentially rectangular die. The die in this case can preferably have extendable jaws in order to hold the partially completed outer box in place after the folding and partial welding.

The method for manufacturing the drawer includes the steps of preparing of a flat blank having a base surface, left and right side surfaces, a rear end surface, left and right reinforcing tabs, first, second, and third rear top tabs, left and right top reinforcing tabs, and a stop tab. This is followed by a step of folding the reinforcing tabs and side surfaces as well as the first and second rear top tabs to produce an essentially U-shaped intermediate form. Then, the reinforcing tabs are welded to the rear wall tab, which was also folded previously. Then, a folding of the top reinforcing tabs and the second and third rear top tabs takes place, followed by a welding of the top reinforcing tabs to the first top tab. Then, the second and third top tabs are folded and the third top tab is inserted into a slot in the base surface. This yields a hollow, rectangular top region of the drawer.

Preferably, the third top tab is also welded to the base surface.

According to another preferred embodiment, the flat blank has left and right semicircular guide tabs at one end of the drawer, which are bent inward after the final welding step.

Preferably, the blank also has a stop tab for limiting an outward movement of the drawer from an outer box. The stop tab is situated in the bottom surface and is folded downward.

In order to make it easy to pull the drawer out from an outer box, the blank is preferably also provided with a pull tab, which is situated at the end opposite from the hollow top region of the drawer. The pull tab is preferably also slightly bent in order to make it easy to grasp.

Preferably, the flat blank is manufactured from a plastic-coated cardboard. Also preferably, the welding is performed by means of ultrasound.

The present invention also relates to a device for implementing the above-described method for manufacturing an outer box and for manufacturing a drawer.

Preferably, a device for manufacturing a package having an outer box and a drawer includes a first machine for manufacturing the outer box and a second machine for manufacturing the drawer, as well as a shared main drive unit. The main drive unit is used to drive devices of the first and second machines.

In order to provide a particularly compact manufacturing device, the main drive unit is preferably situated between the first and second machines.

It is also preferable for the first and second machines to each have a respective conveyor device for transporting the blank through the first and second machines. It is also preferable for the first and second machines to each have at least one respective welding device, in particular an ultrasonic welding device, in order to permit a welding of the outer box and of the drawer, respectively.

In this case, it is particularly preferable for one step of the welding in the first and/or second machine to occur around an essentially rectangular die, which serves as a support device for laying various different walls and tabs of the outer box or drawer, respectively, against one another. After the manufacture of the outer box or drawer, the die is then simply withdrawn.

BRIEF DESCRIPTION OF THE DRAWINGS

Advantageous exemplary embodiments of the invention will be described in detail below in conjunction with the accompanying drawings, in which:

FIG. 3 is a schematic top view of a blank of an outer box of the package, FIG. 4 is a perspective view of the blank during the manufacture of the outer box, FIG. 7 shows a blank for a drawer of the package, FIG. 8 is a perspective view during the manufacture of the drawer.

DESCRIPTION OF THE PREFERRED EMBODIMENT

Figure 1:
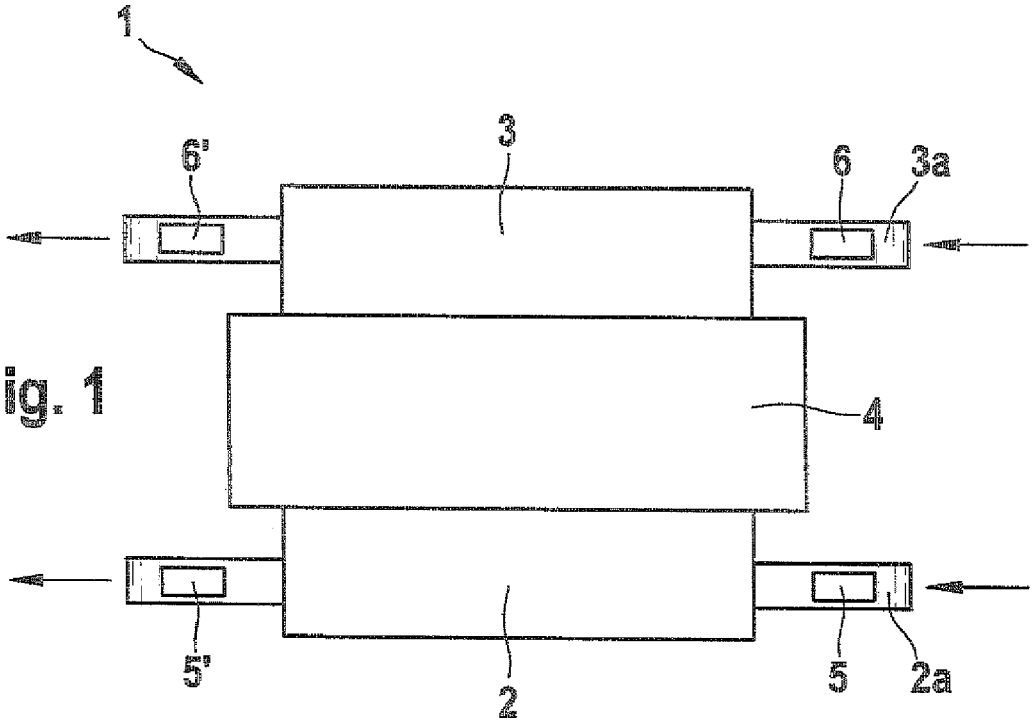
FIG. 1 is a schematic top view of a device for manufacturing a package with an outer box and a drawer according to one exemplary embodiment of the invention.
Figure 2:
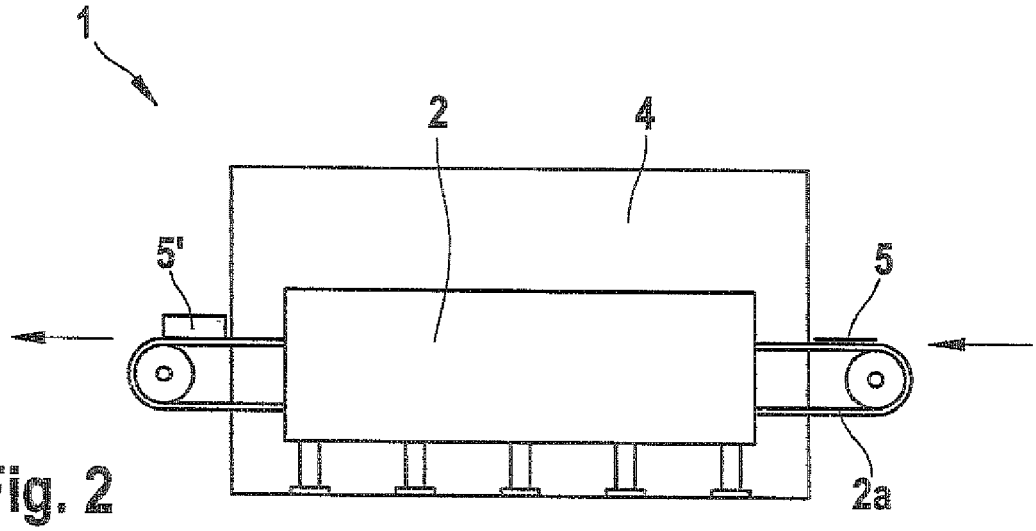
FIG. 2 is a schematic side view of the device shown in FIG. 1.

FIGS. 1 and 2 schematically depict a device 1 according to the invention for manufacturing a package that has an outer box and a drawer. As is clear from FIG. 1, the device 1 has a first machine 2 for manufacturing an outer box 5' and a second machine 3 for manufacturing a drawer 6'. A shared main drive unit 4 is situated between the first machine 2 and the second machine 3. This makes it possible to achieve a particularly compact design. As indicated by the arrows in FIGS. 1 and 2, respective transport devices 2*a* and 3*a* feed a blank 5 for the outer box and a blank 6 for the drawer into the machines 2, 3 from one side. In this case, the directions of travel through the machines 2, 3 are parallel to each other. The first machine 2 and second machine 3 each include a plurality of stations in which the blank is partially folded and welded. This will be described in greater detail below. After the blanks of the outer box and drawer have passed through, the completely folded and welded parts of the package emerge from the other end of the machines and are each carried away by the respective transport device 2*a*, 3*a*.

FIG. 3 gives a detailed view of a blank 5 for the outer box. The blank 5 is manufactured from plastic-coated cardboard and has a large number of prepared folding edges. As is clear from FIG. 3, the blank 5 has a base surface 5*a*, which is adjoined by a rear end surface 5*b*, which is in turn adjoined by a cover surface 5*c*. The sides of the base surface 5*a* are adjoined by left and right base side walls 5*d*. In the longitudinal direction X-X of the blank, the left and right base side walls 5*d* are each adjoined by a respective left and right reinforcing tab 5*e*. The cover surface 5*c* is adjoined at the sides by left and right cover side surfaces 5*g*. The reinforcing tabs 5*e* are separate from the cover side surfaces 5*g* and the rear end surface 5*b*. A respective opening 5*j* is provided in each of the cover side surfaces 5*g*. In addition, a left and right bottom tab 5*h* have been respectively provided on the left and right cover side surfaces 5*g*. The left and right bottom tabs 5*h* are each rounded in their corner regions. The left and right base side walls 5*d* are also each provided with a front support tab 5*f*. Furthermore, the left and right base side walls 5*d* are provided with four locking tabs 5*k*. At the end oriented away from the rear end surface 5*b*, the base surface 5*a* is adjoined by a securing tab 5*l*. In the assembled state of the outer box, the securing tab 5*l* prevents a drawer from falling out. The cover surface 5*c* is also provided with an essentially semicircular upper reinforcing tab 5*m*. In addition, a respective opening 5*i* is provided in each of the left and right base side walls 5*d*. In the assembled state of the outer box, the openings 5*i* in the base side walls 5*d* and the openings 5*j* in the cover side surfaces 5*g* are flush with one another.

Figure 5:
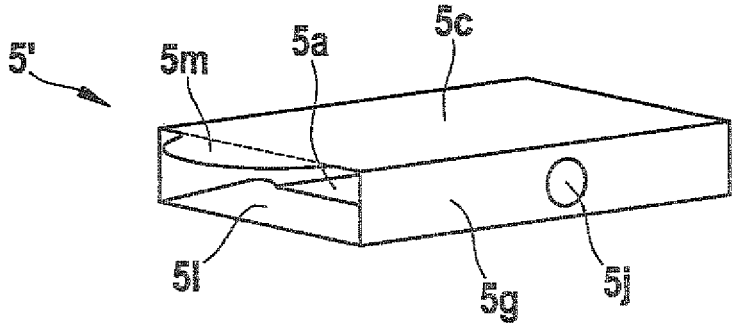
FIG. 5 is a perspective view of the almost completed outer box.
Figure 6A:
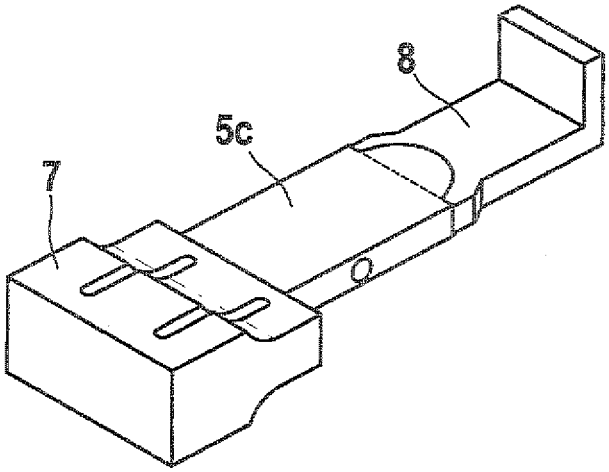
FIGS. 6*a* through 6*e* show schematic views during the manufacture of the outer box.
Figure 6B:
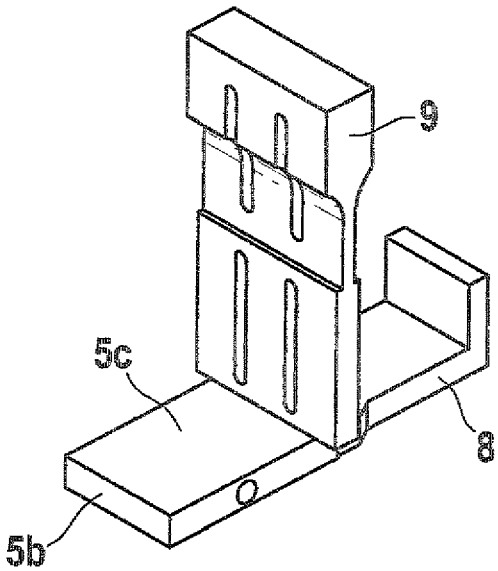
Figure 6C:
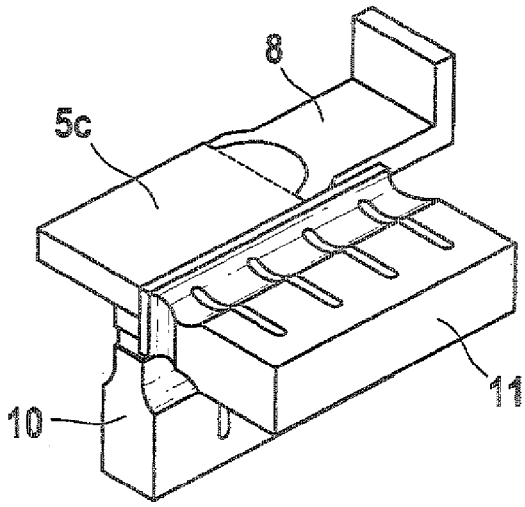
Figure 6D:
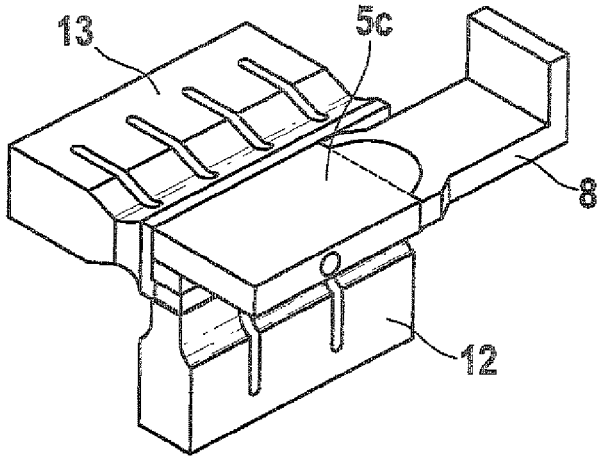
Figure 6E:
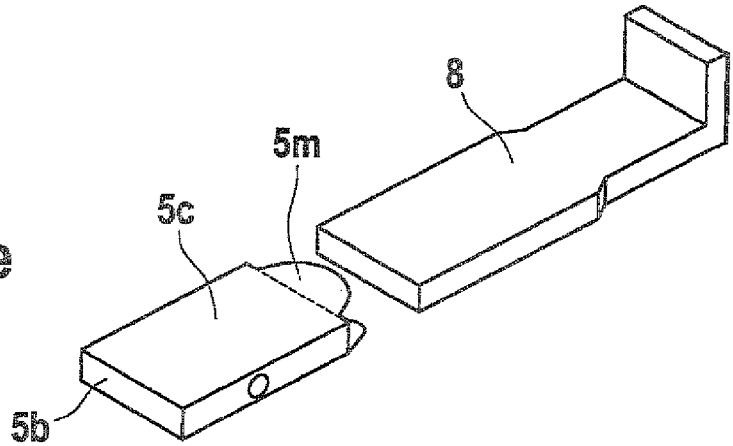

An outer box 5' is manufactured as follows from the blank 5 shown in FIG. 3. In a first step, the locking tabs 5*k* and the left and right reinforcing tabs 5*e* are prefolded. Then, a rectangular die, which has a bottom surface like the base surface 5*a*, is placed onto the base surface 5*a*. Then, the left and right base side walls 5*d* are folded inward by 90° so that they rest against the die. At the same time, or subsequently, the left and right reinforcing tabs 5*e* are also folded inward. Then, the rear end surface 5*b* is folded inward and upward in the direction of arrow A, together with the cover surface 5*c*, as shown in FIG. 4. In a subsequent step, the two front support tabs 5*f* are folded inward by 90°. This state is shown in FIG. 4. Then, the cover surface 5*c* is folded all the way over so that it is parallel to the base surface 5*a* and a weld is produced at the end surface between the left and right reinforcing tabs 5*e* and the rear end surface 5*b*. This is schematically depicted in FIG. 6*a*; the reference numeral 7 indicates an ultrasonic welding device. The reference numeral 8 indicates the die, which is resting against the base surface 5*a*. In a subsequent step, the cover surface 5*c* is welded to the two support tabs 5*f*. This step is schematically depicted in FIG. 6*b*; the welding is performed using an ultrasonic welding device 9. In a subsequent step, the left and right cover side surfaces 5*g* and the left and right bottom tabs 5*h* are folded over. As indicated in FIG. 6*c*, in a first step, a bottom tab 5*h* and a cover side surface 5*g* are simultaneously welded to one longitudinal side of the outer box. The bottom tab 5*h* in this case is welded by means of an ultrasonic welding device 10 and the cover side surface 5*g* is welded by means of an ultrasonic welding device 11. In a subsequent station, the second cover side surface 5*g* and the second bottom tab 5*h* are then welded using a welding device 12 and 13. This is shown in FIG. 6*d*. An additional edge welding of the edges between the bottom tabs and the cover side surface and of the edge of the cover surface 5*c* can optionally be carried out later. In a subsequent step, as shown in FIG. 6*e*, the die 8 is removed from the almost completed outer box. Then, the securing tab 5*l* is folded inward into the inside of the outer box. This state is shown in FIG. 5. In the last step, an upper reinforcing tab 5*m* is likewise folded inward and welded to the cover surface 5*c*. This provides the cover surface 5*c* with an additional reinforcement. This last step can be executed, for example, on a turntable.

Figure 9:
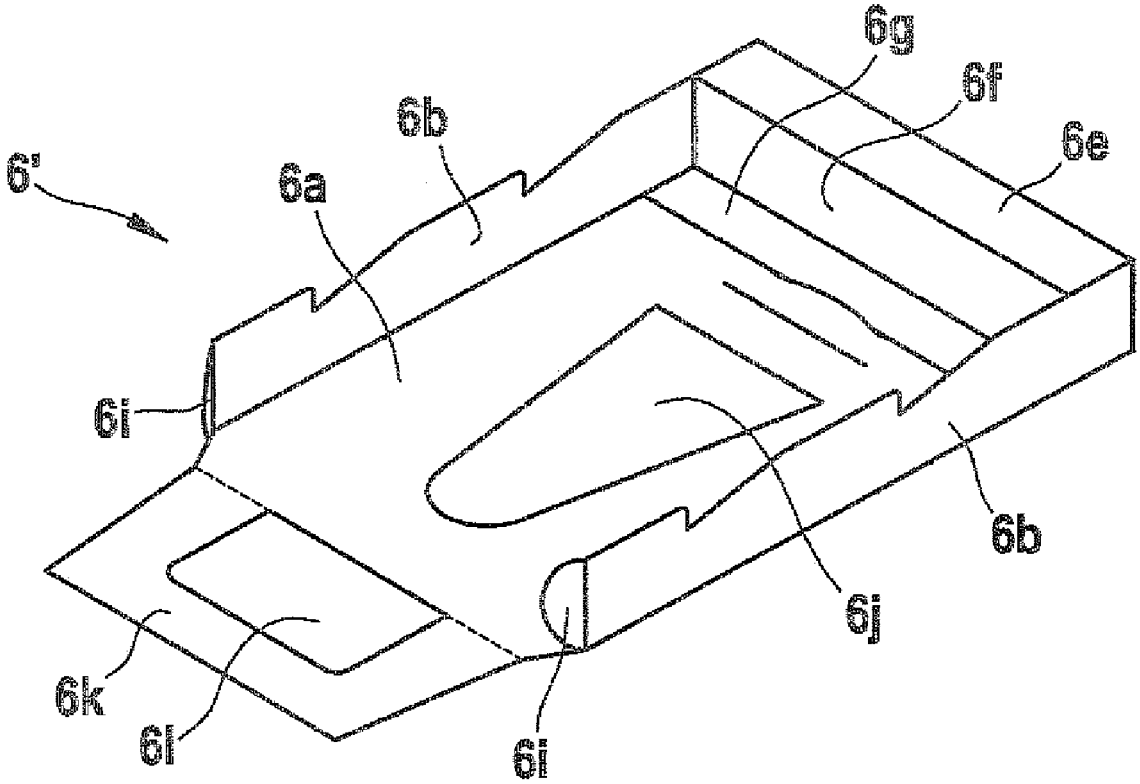
FIG. 9 is a perspective view of a completed drawer.

The manufacture of a drawer 6' from a flat blank 6 for the drawer will be described below in conjunction with FIGS. 7 through 9.

As is clear from FIG. 7, the blank 6 includes a base surface 6*a*, which is adjoined in the axial direction X-X by a rear end surface 6*d* that is in turn adjoined in series by a first, second, and third top tab 6*e*, 6*f*, and 6*g*, as well as by left and right reinforcing tabs 6*c*. The base surface 6*a* is also adjoined by a left and right side surface 6*b*. The left and right side surfaces 6*b* are each adjoined by a respective left and right top reinforcing tab 6*h* and by a respective guide tab 6*i*. A tongue-shaped pull-out tab 6*j* and a slot S are also provided in the base surface 6*a*. As is clear from FIG. 7, the slot has a slightly wavy shape. The base surface 6*a* is also provided with a pull tab 6*k*.

In a first step, the left and right reinforcing tabs 6*c* are folded upward by approximately 90°. The guide tabs 6*i* can also be folded inward at the same time. In a subsequent step, an essentially rectangular die with the dimensions of the base surface 6*a* is placed onto the base surface 6*a*. The tabs 6*f* and 6*g* are then prefolded and the pull-out tab 6*j* is folded over.

Then, the left and right side surfaces 6*b* are folded upward by approximately 90° and laid against the die, thus producing an essentially U-shaped intermediate form, and the edges between the first top tab 6*e*, the second top tab 6*f*, and third top tab 6*g* as well as the rear end surface 6*d* are folded. The pull-out tab 6*j* is also pushed outward and downward. This state is shown in FIG. 8. In a subsequent step, the two left and right reinforcing tabs 6*c* are welded to the rear end surface 6*d*. Then, the left and right top reinforcing tabs 6*h* are folded inward so that they are oriented parallel to the base surface 6*a*, and the top reinforcing tabs 6*h* are welded to the first top tab 6*e*. It should be noted that the three top tabs 6*e*, 6*f*, and 6*g* form a hollow top region with the rear end surface 6*d*. This makes a significant contribution to stiffening the drawer. Then, the die, which is not shown, is removed from the base surface 6*a* and the second top tab 6*f* and third top tab 6*g* are folded inward. In the course of this, the third top tab 6*g* is inserted part way into the slot S in the base surface 6*a*. It should be noted that alternatively, the third top tab 6*g* can also be welded to the base surface 6*a*. This completes the drawer 6', as shown in FIG. 9.

A package, composed of the outer box 5', which is manufactured as described above, along with the drawer 6' that can be inserted into it, can be manufactured with an extremely high degree of precision. This makes it possible to assure a reliable functioning of the drawer inside the outer box. This also yields a very mechanically stable package. It should be noted that the steps for bending, for example by raising and lowering the blank, can be carried out with a die placed against the edge that is to be bent. In the assembled state, the securing tab 5*l* of the outer box also constitutes a stop for the stop tab 6*l* of the drawer.

The outer box and the drawer are preferably manufactured from a cardboard material that is coated with plastic on both sides. It is also conceivable, however, for the outer box and/or the drawer to be completely manufactured from a plastic material.

The foregoing relates to the preferred exemplary embodiment of the invention, it being understood that other variants and embodiments thereof are possible within the spirit and scope of the invention, the latter being defined by the appended claims.

The invention claimed is:

1. A method for manufacturing an outer box with an open front end surface and a closed rear end surface, including the following steps of:

preparing a flat blank for the outer box, the flat blank including left and right reinforcing tabs;

placing a die onto a base surface of the blank to form the outer box therearound;

folding the blank from flat to produce a U-shaped intermediate form by folding left and right base side walls relative to the base surface so as to rest against the die;

folding the left and right reinforcing tabs inward before folding of a rear end surface;

folding the rear end surface, which adjoins the base surface with the die still disposed on the base surface;

folding a cover surface onto the U-shaped intermediate form, with the cover surface adjoining the rear end surface;

welding the left and right reinforcing tabs to the rear end surface; and welding the cover surface to the U-shaped intermediate form by ultrasound sealing;

and then removing the die from the outer box.

2. The method as recited in claim 1, wherein the blank includes two front support tabs that are folded inward before the folding of the cover surface and are welded to the cover surface.

3. The method as recited in claim 2, wherein the welding of the left and right reinforcing tabs to the rear end surface and the welding of the front support tabs to the cover surface occurs at the same time.

4. The method as recited in claim 1, wherein the cover surface is adjoined in the longitudinal direction of the outer box by left and right cover side surfaces that are welded to the left and right base side walls.

5. The method as recited in claim 4, wherein the left and right cover side surfaces are adjoined by left and right bottom tabs that are welded to an underside of the base surface.

6. The method as recited in claim 1, wherein the blank also has a securing tab, which is situated on the base surface and is folded inward into the outer box after the welding of the cover surface.

7. The method as recited in claim 1, wherein the cover surface is adjoined by an upper reinforcing tab, which, after the welding of the cover surface, is folded inward into the outer box and welded to the cover surface.

8. The method as recited in claim 1, wherein the blank is folded into a U-shaped intermediate form around an essentially rectangular die.

* * * * *